United States Patent [19]

Loeffel

[11] 4,285,556

[45] Aug. 25, 1981

[54] TOOL CHEST

[76] Inventor: Emil Loeffel, 141 Centre St., Waldwick, N.J. 07463

[21] Appl. No.: 124,549

[22] Filed: Feb. 25, 1980

[51] Int. Cl.[3] ..... A47B 51/00; A47B 81/00; B65D 85/28

[52] U.S. Cl. ..... 312/244; 312/DIG. 33; 312/290; 312/312; 211/169; 206/372

[58] Field of Search ..... 312/244, DIG. 33, 312, 312/287, 289, 290; 206/372, 373; 211/169

[56] References Cited

U.S. PATENT DOCUMENTS

| | | | |
|---|---|---|---|
| 652,778 | 7/1900 | James | 312/244 |
| 1,104,917 | 7/1914 | Miller | 312/287 |
| 1,113,832 | 10/1914 | Roth | 312/DIG. 33 |
| 2,519,490 | 8/1950 | Miller | 312/244 |
| 2,710,093 | 6/1955 | Raker | 312/244 |
| 2,804,226 | 8/1957 | Freedman | 312/289 |
| 2,845,323 | 7/1958 | Seibert, Jr. | 312/244 |
| 3,872,342 | 3/1975 | Dankert | 312/290 |
| 4,058,210 | 11/1977 | Mitchell | 312/DIG. 33 |
| 4,170,392 | 10/1979 | Spevak | 312/DIG. 33 |
| 4,173,284 | 11/1979 | March | 312/DIG. 33 |

FOREIGN PATENT DOCUMENTS

| | | | |
|---|---|---|---|
| 2659589 | 12/1976 | Fed. Rep. of Germany | 312/DIG. 33 |

*Primary Examiner*—Victor N. Sakran
*Attorney, Agent, or Firm*—W. Patrick Quast

[57] ABSTRACT

What is disclosed is a tool chest which comprises a main support housing; a center member slideably mounted in the main support housing; side members pivotally mounted to the main support housing; and means for supporting tools comprising part of the center member and each of the side members. The main support housing further includes a pair of support blocks which limit the downward vertical travel of the center member creating a storage area at the bottom of the chest.

The slideable mount for the center member includes a cooperating groove and track. The track portion includes a spring biased section which is forced into the vertical path of the center member when the latter is raised above a certain height. It then provides a support ledge for holding the center member in its vertically disposed position, making the storage area accessible.

The handle for carrying the chest includes cooperating handle sections disposed on the side members. When the latter are closed, the cooperating sections can be secured together by the placement of a lock in the aligned holes.

12 Claims, 6 Drawing Figures

TOOL CHEST

BACKGROUND

This invention relates generally to a chest for carrying tools and the like, but, more particularly, to a chest which is constructed to display all storage areas at once and to provide ready access to all tools, etc. stored therein.

There are various tool chests available servicing the individual needs of carpenters, mechanics, roofers, etc. Generally, these chests include a plurality of drawers or trays which contain various tools and which must be opened or removed from the tool chest to provide visibility and availability. The present inventor is unaware of a portable, ready access and total display type of chest for the various disciplines.

It is therefore a primary object of the present invention to provide a tool or parts storage and display chest which provides display and ready access to all items within.

It is yet another object of this invention to provide a suitcase-like, portable chest.

It is still another object of this invention to provide a chest which is economical to manufacture and which can be fashioned from various materials.

It is still a further object of this invention to provide a chest which includes a removable center section which increases its versatility.

SUMMARY OF THE INVENTION

Towards the accomplishment of these and other objects of the invention which will become apparent from the drawings and accompanying description which follows, there is described a chest for the storage of tools and the like which comprises a main support housing; a center member slideably mounted in the main support housing in a vertical direction when the chest is upright; at least one side member pivotally mounted to the main support housing; and means for supporting tools and the like forming part of the center member and the side member. The main support housing further includes first support means disposed therein for limiting the vertical travel of the center member in the downward direction. This results in a storage area at the bottom of the chest. In an embodiment of the invention, where there are two side members, handle means are provided which include cooperating sections disposed on each side member which form the handle means when the side members are pivoted to form a closed chest. In an embodiment of the invention, a slideable mounting of the center member includes cooperating groove and track means, the track means comprising a spring biased means which is urged into the vertical path of the center member when the latter is raised a certain height. The spring biased means includes means of supporting the center member in its vertically raised position. In yet another embodiment, the center member includes second support means which are pivotally mounted to its bottom portion. The second support means pivot between a vertically extended position wherein the center member is supported in a vertically raised position, and a horizontally disposed position. In the latter, the second support means provide a stable base for maintaining the center member upright when it is removed from the chest.

The cooperating handle sections referred to above can include respective openings which align themselves when the center members are closed, and which are adapted to accept a locking device in this position.

DESCRIPTION OF THE PREFERRED EMBODIMENT

Figure 1:
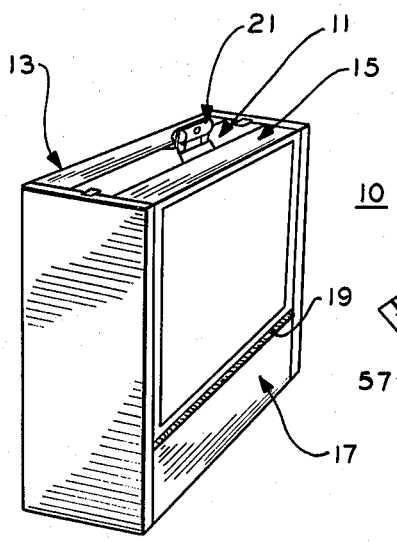
FIG. 1 is a perspective view of the present invention shown closed up.

Referring now to the drawings and, particularly, FIG. 1, the chest is shown in its closed condition ready for toting by the operator to a job site or the like. The chest, 10, is seen to include a rectangularly shaped center member, 11, about which are closed, rectangularly shaped side members, 13 and 15. The latter are pivoted to a main support housing, 17, by piano hinges such as 19. The unit is transported via handle, 21, which is formed by cooperating members disposed on side members, 13 and 15.

Figure 2:
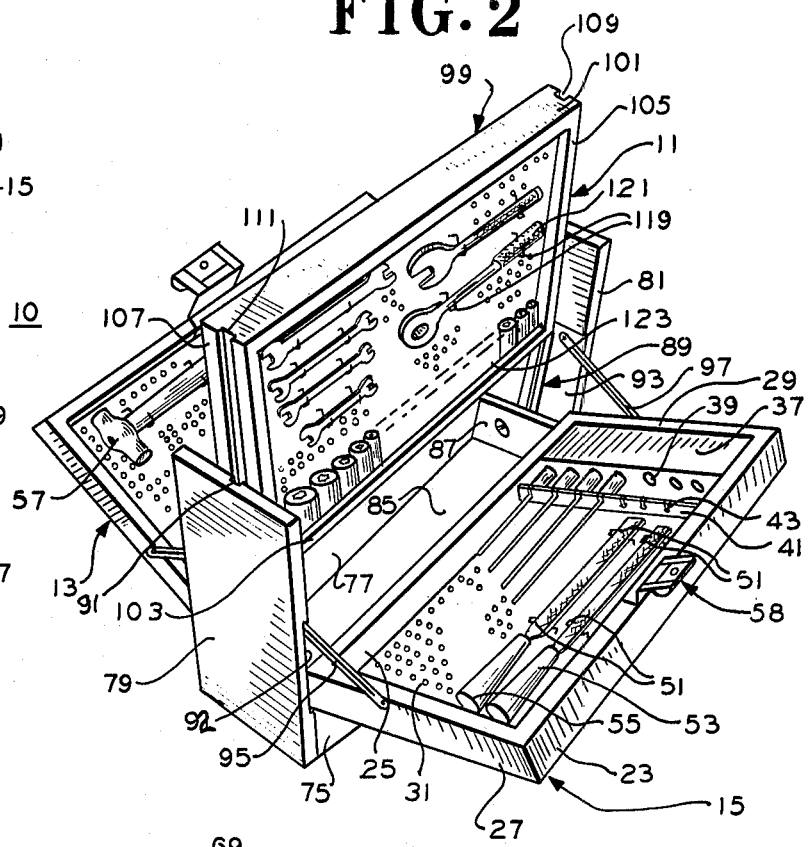
FIG. 2 is a perspective view of the invention, with the side members opened revealing the interior of the chest and showing the removable center member and storage area.

Referring to FIG. 2, the view shows the chest, 10 of FIG. 1, opened. It is seen to include the removable center member, 11, opened side members, 13 and 15, and main support housing, 17.

Hinged to side sections of the main support housing are side members, 13 and 15. The latter, when opened, appear as rectangular sections. They include a top and bottom section, 23 and 25, for example, and side, end sections, 27 and 29. These are interconnected at the corners in various known ways, not the object of this invention.

Figure 3:
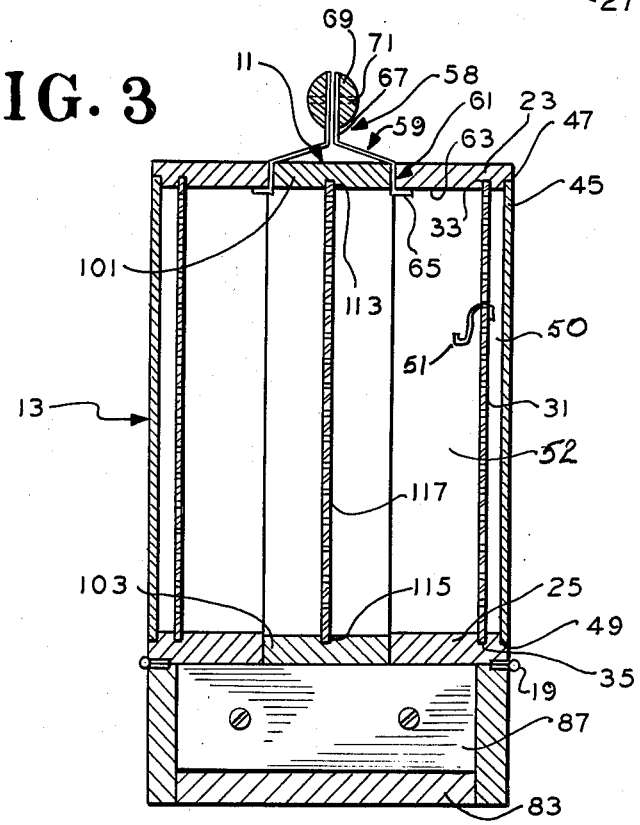
FIG. 3 is an elevational view of a section cut through the chest, parallel to the end sections (without tools or tool support blocks in place).

Disposed in the side member, for example, 15, is a piece of pegboard, 31. Referring to FIG. 3, the piece of pegboard slides into suitable grooves, 33 and 35, in sections 23 and 25. It bottoms in a corresponding groove in end section 29 and a like groove in section 27. Once the pegboard is in place the end sections, 27 and 29, are joined to sections 23 and 25.

Also disposed in the side member can be a tool handle, supporting block 37. This is secured in the side member by suitable means, for example, screws, glue or other appropriate way. The supporting block, 37, includes appropriately shaped cutouts, for example, 39, which are sized to accommodate the various tool handles expected to be stored.

In the situation where a tool handle supporting block is employed, there will usually be required a further piece, 41, which supports the blade or shaft of the particular tool. This, likewise, includes appropriately shaped cutouts, for example, 43, for accommodating various tools. The shaft support piece is also secured in the side member by various known techniques, such as by screws, gluing or other appropriate way.

As shown in FIG. 3, the outboard side of the side members is formed typically by a masonite or particle board member such as 45. The latter is disposed in grooves, 47 and 49, in side sections 23 and 25, and comparably shaped grooves in end sections, 27 and 29. The particle board typically is cemented in these grooves. The double wall formed by 31 and 45 serves to strengthen the side member, 15. Space 50 between the pegboard and the side board member is sufficient to allow clearance for the ends of S-hooks, 51. Member 45 covers the ends of the S-hooks which would otherwise be exposed. Space 52 is large enough to handle bigger tools. The S-hooks are judiciously positioned on the pegboard to support a variety of tools. These might include, for example, files, such as 53 and 55, a hammer, 57, saws or other assorted tools.

As mentioned above, handle 21 is formed by cooperating members disposed on side members, 13 and 15. Referring to FIG. 3, one such member, 58, is seen to include a shaped bracket, 59, which is contoured to conform at the one end with edge 61 of section 23. The bracket is secured to the underside, 63, of side sections, for example, 23, by a flange, 65. The bracket extends obliquely over the center member, 11, and then vertically upward. The last mentioned vertically extending section is formed typically by two tabs, for example, 67. Secured to these tabs in any suitable manner is a grip section, 69. A thru hole, 71, is drilled through the latter and is cooperatively aligned with a similar opening in the other member forming the handle. These accommodate a suitable device for locking the chest.

Side member 13 is of comparable construction to that described for side member 15.

Of course, the individual side members are not restricted to the above described configuration, but there is afforded within the bounds of the present invention a versatility necessary for the variety of tools which are employed in various disciplines. For example, the side members need not necessarily include tool supporting pieces, such as 37 and 41, etc. Further, they may include part support ledges such as described hereinafter with respect to center member, 11.

Returning to FIG. 2, the main support housing, 17, is seen to include side sections, 75 and 77, vertically extending end sections, 79 and 81, and bottom section, 83 (see FIG. 3). The sections are joined in any known fashion to form a box arrangement which includes a storage area, 85, defined in the vertically extending direction by the top surfaces of sections 75 and 77.

Secured to the inboard sides of side sections, 79 and 81, are side support blocks such as 87. These are disposed in the storage area, 85. They provide a support ledge for the center member, 11, when the latter is lowered into its bottom most position. This maintains the center member, 11, elevated above the storage area, 85.

Running the vertical length of each side section, 79 and 81, are tracks such as 89. The latter is a composite piece which is set in a cooperating groove, 91, in the corresponding end section. The details of the construction of the track are described hereinafter in conjunction with FIG. 4.

The end sections, 79 and 81, are also grooved such as at 92 and 93 to accommodate side member support stays, 95 and 97.

Center member 11 is seen to comprise an outer frame, 99, which is formed from top and bottom sections, 101 and 103; and side sections, 105 and 107. The latter have vertically extending grooves, 109 and 111, which complement the respective tracks disposed on side end sections, 79 and 81. Internal grooves such as 113 and 115 (see FIG. 3) in top and bottom sections 101 and 103 are used to vertically align and retain a further piece of pegboard, 117. Comparable grooves are likewise found in side sections 105 and 107. Once the pegboard, 117, is in place, the various sections of the outer frame, 99, are secured one to the other to make an internal center member.

Disposed in the various holes in pegboard 117, again, are suitable hanging means, such as S-hooks, 119. These retain various required tools such as hammers, saws, wrenches, 121, etc. The hooks can be positioned on either side of the pegboard, 117, or both, to hang tools.

Top surface, 123, of bottom section, 103, provides a ledge area on either side of the pegboard, 117. Ratchet sockets, tool bit storage blocks and other items can be stored on this ledge. Vertically extending pins may be employed in this top surface, 123, to retain such items as the ratchets for a socket wrench. A vertically extending side wall may be employed for retaining such items.

Of course, the center member storage area can be varied to provide a multiplicity of arrangements. For example, the tool handle and shaft holding blocks as described above may be employed. The variety of arrangements should be obvious.

Figure 4:
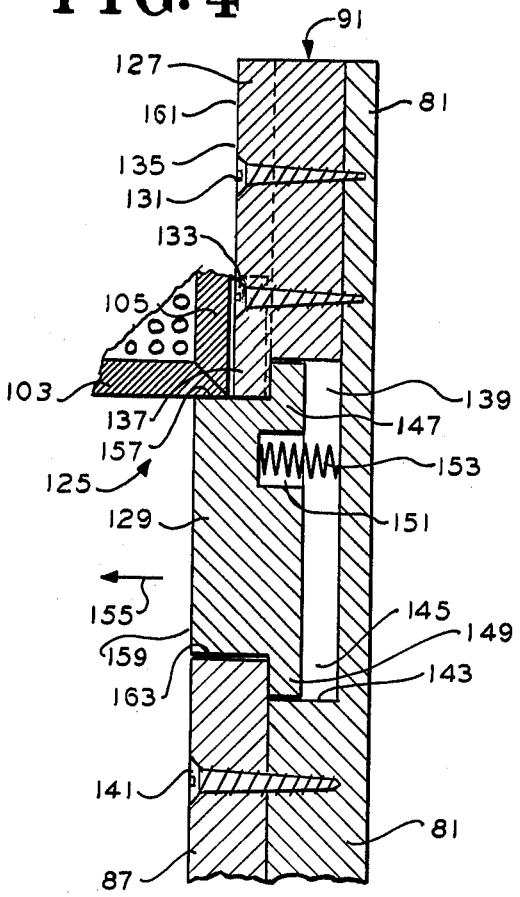
FIG. 4 is a partial, sectional view taken along 4—4 in FIG. 5 and showing a portion of the invention.

Center member 11 is raised and lowered by the operator by gripping the top section, 101, and urging it up and down along the tracks, 89. If desired, the operator can leave the center member in the support housing, in a raised position, so as to make the storage area, 85, accessible. The operator does this by raising the center member a predetermined distance whereupon one portion of the track, 89, which is spring biased, is thrust outward into the path of the member, 11. This provides a "seat" whereupon the raised unit can rest. FIG. 4 provides the details of the composite track member.

Referring now to FIG. 4, such a composite track member, 125 (89 in FIG. 2), is shown.

Top section 127 is secured to the main support housing end section 81 via screws, 131 and 133. The screws are countersunk so that the heads are flush with surface 135.

Section 127 further includes a downward extending flange member, 137, which defines a recess area, 139, in the corresponding location of groove 91.

As noted above, secured to the bottom portion of main support housing end sections 79 and 81, is a support block, 87, which is secured to the end section by screws, 141, or the like. Block 87 extends vertically above the surface, 143, defining the bottom of the groove, 91, to form a second recess area, 145.

Section 129 of the composite member is seen to include two flange sections, 147 and 149. When Section 129 is disposed in the groove, these flange members are disposed in the recess areas, 139 and 145.

Formed in the rear side of section 129 is a recess area, 151. Positioned therein is a coil spring, 153, which is biased against the section, 129, urging the latter in the direction of arrow, 155. Flange sections 147 and 149 coact with 137 and 87 to capture section 129 in the position shown.

In this position, surface 157 acts as a ledge to support the corner of member 11 which is formed at the juncture of sections 103 and 105.

To lower member 11, the user would depress section 129 in a direction opposite that of arrow, 155. When surface 159 is coplanar with surface 135, member 11 is then able to be lowered until it comes to rest on surface 163 of block 87.

Again, when the center member 11 is raised, and the corner formed by sections 103 and 105 is positioned above surface 157, spring, 153, urges section 129 into the support position depicted.

Figure 5:
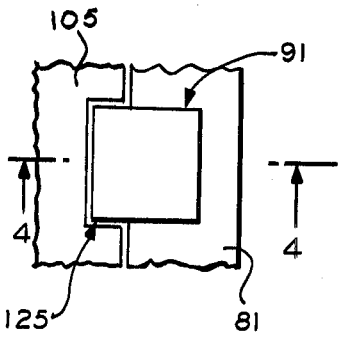
FIG. 5 is a plan, sectional view of an end member showing the track disposed in a cooperating groove.

FIG. 5 is a plan view of one end section showing for reference purposes the relationship of the composite track member, 125 (89), in groove 91.

Figure 6:
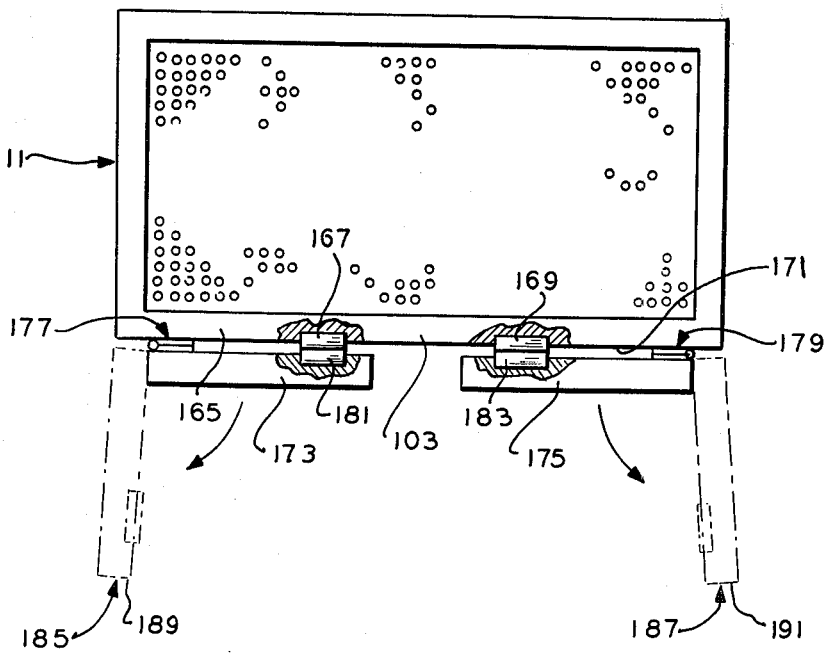
FIG. 6 shows another embodiment of the center section in perspective.

Referring to FIG. 6, there is shown another embodiment for support means of center member 11 in its raised position. Bottom section, 165, is seen to include, at each end thereof, recesses for accepting magnetic pieces, 167 and 169. The recesses are of sufficient depth such that the magnetic pieces are relatively flush to the undersurface, 171, of section 165. Blocks such as 173 and 175 are hinged to the undersurface 171 at points 177 and 179.

Blocks 173 and 175 include magnetic pieces, 181 and 183, which align with pieces 167 and 169 when the blocks are parallel to section 165. The latter are normally retained in this position through the cooperative action of the magnetic pieces.

When it is desired to raise the center member 11 but leave it in the chest at the appropriate point, the blocks are moved from their horizontally aligned position to the vertically extending position shown in phantom as 185 and 187. In this position, the undersurfaces, 189 and 191, rest on bottom section 83 or on the top surface of the support blocks, 87. The length of the blocks, as is the case with the height of section 129 above, allows for displacement of the member vertically a sufficient distance to provide visual and physical access to the storage area, 85, yet still retaining the member 11 in the chest proper.

If it is desired to lower the chest at this point, the operator would unweight the blocks, 173 and 175, and return them to their horizontally aligned position, and then lower the member into the chest.

If it is desired to remove the member 11 from the chest, the operator continues to lift the center member until it clears itself from the side sections, 79 and 81. The blocks, 173 and 175, are left in their horizontally aligned position with the bottom section, 103. The blocks are designed such that their width, when viewed in a plan view, is sufficiently greater than the width of section 103, so as to provide a suitable base for the center member 11 when it is removed from the chest.

Obviously, there are many adaptations of the above described embodiment which can be made and within the scope of the invention. For example, the handle has been described as a composite of two sections which fold away as the side members are lowered. The handle could be a single piece screwed into the top of the center member 11 with appropriate latches employed to secure the side members to the housing or the center member when the chest is closed.

The chest parts can be fabricated from wood, plastic, sheet metal or a combination of these and still be within the scope of the invention.

Many other variations to the ideas disclosed herein can be effected but, again, not limiting the breadth of the invention as defined in the appended claims.

What is claimed is:

1. A chest for the storage of tools and the like comprising:

(a) a main support housing;

(b) a center member slideably mounted in said main support housing in a vertical direction when said chest is upright, said center member unattachably mounted in said housing, whereby said center member can be removed from said housing, said center member including a vertically disposed board member and means disposed thereon for supporting tools and the like; and (c) at least one side member pivotally mounted to said main support housing, said side member including a board member and means disposed thereon for supporting tools and the like, said board member orientated in a vertical position when said side member is pivoted to form a closed chest, and said board member orientated in a position between vertical and horizontal when said side member is pivoted to an open position.

2. A chest for the storage of tools and the like comprising:

(a) a main support housing;

(b) a center member slideably mounted in said main support housing in a vertical direction when said chest is upright, said center member unattachably mounted in said housing, whereby said center member can be removed from said housing, said center member including a vertically disposed board member and means disposed thereon for supporting tools and the like; and (c) two side members pivotally mounted to said main support housing, said side members including respective board members and means disposed on each for supporting tools and the like, said side member, board members orientated in a vertical position when said side members are pivoted to form a closed chest, and said side member, board members orientated in a position between vertical and horizontal when said side members are pivoted to an open position, whereby four separate vertical storage areas are provided in a compact arrangement such that total access to the stored items is obtained by pivoting the side members to an extent that provides complete access to the stored items but not enough to cause disorientation of the items stored thereon.

3. The chest claimed in either claim 1 or claim 2 wherein said main support housing further includes first support means disposed therein for limiting the vertical travel of said center member in the downward direction, whereby a fifth storage area is formed at the bottom of the chest.

4. The chest claimed in either claim 1 or claim 2 wherein the slideable mounting of the center member includes cooperating groove and track means, said track means including spring biased means which is urged transversely into the vertical path of said center member when the latter is raised a certain height, said spring biased means including means for supporting said center member in its vertically raised position.

5. The chest claimed in either claim 1 or claim 2 wherein said center member further includes second support means, said second support means pivotally mounted to the bottom portion of said center member, said second support means pivotally mounted between a vertically extended position and a horizontally disposed position, said second support means in said vertically extended position supporting said center member in a vertically raised position in said chest.

6. The chest claimed in either claim 1 or claim 2 wherein said center member further includes second support means, said second support means pivotally mounted to the bottom portion of said center member, said second support means pivotally mounted between a vertically extended position and a horizontally disposed position, said second support means in said vertically extended position supporting said center member in a vertically raised position in said chest, and wherein said second support means includes means for retaining said second support means in a horizontally disposed position when said center member is displaced from its bottomed position in the chest.

7. The chest claimed in either claim 1 or claim 2 wherein said center member further includes second support means, said second support means pivotally mounted to the bottom portion of said center member, said second support means pivotally mounted between a vertically extended position and a horizontally disposed position, said second support means in said vertically extended position supporting said center member in a vertically raised position in said chest, and wherein said second support means includes means for retaining said second support means in a horizontally disposed position when said center member is displaced from its bottomed position in the chest, and wherein said means for retaining include cooperating magnetic pieces disposed in said second support means and said center member.

8. The chest claimed in either claim 1 or claim 2, said chest further including handle means, said side members including cooperative handle sections which form said handle means when said side members are pivoted to form a closed chest.

9. The chest claimed in either claim 1 or claim 2, said chest further including handle means, said side members including cooperative handle sections which form said handle means when said side members are pivoted to form a closed chest, and wherein said handle sections include respective openings which are aligned when said side members are pivoted to a closed position, said openings adapted to accept locking means when in the aligned position.

10. The chest claimed in either claim 1 or claim 2 wherein said means for supporting tools and the like includes a storage ledge disposed along one side of at least one of said center member or said side members.

11. The chest claimed in either claim 1 or claim 2 wherein said center member provides storage capability on both vertical sides thereof.

12. The chest claimed in either claim 1 or claim 2 wherein the means for supporting tools and the like include periodically spaced perforations on a board which accept complementary hanging means to provide a variety of tool storage arrangements.

* * * * *